United States Patent [19]

Dutkewych et al.

[11] 4,130,454

[45] Dec. 19, 1978

[54] ETCHANT AND PROCESS OF ETCHING WITH THE SAME

[76] Inventors: Oleh B. Dutkewych, 54 Highland Ave., Maplewood, N.J. 07040; Charles A. Gaputis, 423 Maple Blvd., Apt. 3W, Kansas City, Mo. 64124; Michael Gulla, 24 Ivy La., Sherborn, Mass. 01770; Leonard R. Levy, 6 Colonial Dr., Framingham, Mass. 01701

[21] Appl. No.: 822,002

[22] Filed: Sep. 30, 1977

Related U.S. Application Data

[63] Continuation-in-part of Ser. No. 646,476, Jan. 5, 1976, abandoned.

[51] Int. Cl.$^2$ ..... C23F 1/02

[52] U.S. Cl. ..... 156/659; 156/656; 156/666; 156/902; 252/79.2; 427/96

[58] Field of Search ..... 252/79.2, 79.4; 156/656, 659, 666, 901, 902; 29/625, 626; 427/96, 97

[56] References Cited

U.S. PATENT DOCUMENTS

| | | | |
|---|---|---|---|
| 2,377,593 | 6/1945 | Vande Bunte | 252/79.2 |
| 2,441,300 | 5/1948 | Vande Bunte | 252/79.2 |

*Primary Examiner*—William A. Powell

*Attorney, Agent, or Firm*—Dike, Bronstein, Roberts, Cushman & Pfund

[57] ABSTRACT

This invention is directed to an etchant and to a process for its use. The etchant comprises a synergistic combination of hydrogen peroxide and molybdenum as oxidants in acidic solution. The combination of oxidants provides for sustained etching at an exalted rate. The etchant is useful for etching metals, especially copper and its alloys, and is particularly useful in the manufacture of printed circuit boards.

18 Claims, No Drawings

ETCHANT AND PROCESS OF ETCHING WITH THE SAME

CROSS REFERENCE TO RELATED APPLICATIONS

This application is a continuation-in-part of U.S. Pat. application Ser. No. 646,476 filed Jan. 5, 1976, now abandoned.

BACKGROUND OF THE INVENTION

1. Introduction

This invention relates to etchants comprising a synergistic combination of hydrogen peroxide and molybdenum as oxidants in acidic solution.

2. Description of the Prior Art

The activation of relatively dilute mineral acids with an oxygen release compound is known in the art and described, for example, in *Plating*, "Surface Treatment of Metals with Peroxygen Compounds", Vol. 42, pg 561 (1955). In the *Plating* publication, it is taught that mineral acids such as sulfuric acid, nitric acid, acetic acid and phosphoric acid may be activated with oxygen release compounds such as hydrogen peroxide or other peroxy, persulfate or perborate compounds. The oxygen release compound enhances the etch rate thereby permitting a decrease in the concentration of acid.

Activation of dilute sulfuric acid with hydrogen peroxide is most attractive due to low cost and ease of electrolytic copper recovery from the spent etchant prior to disposal. However, the utility of such hydrogen peroxide etching solutions is reduced somewhat due to catalyzed decomposition of hydrogen peroxide caused by etched metal ions or other transition metal ions in solution and a slow etch rate, typically 1.4 mils of copper from 1 ounce copper clad laminate in 10–25 minutes at 120° F. To enchance etch rate, more concentrated solutions of hydrogen peroxide have been used, but concentrated peroxide solutions are hazardous to health and safety. In addition, such etchants have not been successfully used with tin dissimilar metal etch resists because they attack tin, especially immersion tin.

To limit metal ion catalyzed decomposition of hydrogen peroxide, a number of stabilizers are used in the prior art. A variety of such stabilizers is disclosed in U.S. Pat. Nos. 3,293,093; 3,341,384; 3,407,141; and 3,668,131, all incorporated herein by reference. A preferred class of stabilizers is disclosed in U.S. Pat. Nos. 3,801,512 incorporated herein by reference. The stabilizers disclosed in said patent are the arylsulfonic acids.

Though stabilized acid solutions activated with hydrogen peroxide are improved over their unstabilized counterparts, nonetheless they still possess disadvantages which limit their use, particularly for the manufacture of printed circuit boards.

SUMMARY OF THE INVENTION

In accordance with the subject invention, a new etchant is provided which comprises a synergistic combination of oxidants comprising hydrogen peroxide and a molybdenum compound in an acidic solution. The hydrogen peroxide provides sustained etching with the advantages and disadvantages described above. In the acid/peroxide environment, the molybdenum etches at a substantially greater rate and therefore exalts the rate to a desirable level for commercial use. The molybdenum cannot be used as a sole oxidant because it is rapidly depleted as it is reduced to a lower valent form as etching proceeds. It is therefore incapable of providing sustained etching. Though not wishing to be bound by theory, it is believed that the combination of the peroxide and the molybdenum is a synergistic combination because both are believed to etch though the peroxide in the acid environment is believed to provide the secondary function of oxidizing molybdenum to a higher valence capable of etching metals in the acidified peroxide environment.

DESCRIPTION OF THE PREFERRED EMBODIMENTS

It is known that molybdenum has a valence of +6 in its most stable valence form but is reducible to the lower valence forms of any of +5, +4, +3 or +2. It is also known that molybdenum, in acidified peroxide environments, forms permolybdate. *Encyclopedia Britannica*, Vol. 15, 1959 Edition, pp 682–683. Recognizing the above, it is believed that etching takes place through several mechanisms. First, the permolybdate and the hexavalent molybdenum oxidize the metal etched with concomitant reduction of the molybdenum to a lower valence state which may be any one or more of the +5 to +2 forms. The peroxide also oxidizes the metal etched in accordance with known reactions. In addition, it is believed that the peroxide performs the additional role of reoxidizing the reduced molybdenum back to hexavalent form which in turn is converted to permolybdate. Therefore, molybdenum available for etching is not consumed as etching proceeds and need only be replenished in incidental amounts sufficient to compensate for that lost through drag-out. As to the peroxide, it is consumed and should be replaced in amounts approximately sufficient to replace that consumed by etching and by reoxidizing the molybdenum.

The peroxide content of the etchant may vary within relatively broad limits such as from 0.1 to 10 moles per liter of solution. However, because peroxide is a relatively dangerous material to handle, its concentration is preferably maintained relatively low and preferably varies between about 0.5 and 2.5 moles per liter.

As above, the molybdenum compound is added to the etchant as a synergistic co-oxidant with the hydrogen peroxide to exalt the etch rate. The particular molybdenum compound used does not appear to be critical provided it is sufficiently soluble in solution and is oxidized to a form that etches metal in the etchant environment. Preferably, the molybdenum is added as hexavalent molybdenum but may be added in a lower valence form as the peroxide will oxidize it to its higher valence form. The preferred molybdenum compound is sodium molybdate. Other useful molybdenum compounds include ammonium molybdate and molybdic acid.

The concentration of the molybdenum compound is not critical, it having been found that for immersion etching, the etch rate increases with small additions of molybdenum and levels off as concentration increases. For etching copper, some exaltation of the etch rate occurs when the molybdenum concentration is as low as 0.01 moles per liter (as molybdenum metal) and rapidly increases as the concentration increases to about 0.1 to 0.15 moles per liter. Thereafter, the etch rate continues to increase, but at a less rapid rate to a maximum rate obtained at between about 0.4 to 1.0 moles per liter dependent upon numerous variables such as temperature, peroxide content, dissolved metal content and the like. For spray etching, an exalted rate occurs at higher concentrations of molybdenum than for immersion etching.

Based upon the above, it should be apparent that the molybdenum content may vary within broad limits provided its concentration is sufficient to exalt the rate to that desired. Preferably, the concentration varies between 0.01 and 1.0 moles per liter and more preferably between 0.02 and 0.5 moles per liter.

With regard to the above concentrations for both the peroxide and the molybdenum, it has been found that to obtain satisfactory etching, the molar ratio of the peroxide to the molybdenum should be at least 1:1 and more preferably, at least 1.2:1. The upper limit to this ratio is of lesser importance.

The acid used is in part dependent upon the metal to be etched. For example, for etching copper, sulfuric acid is preferred because it is economical, yields copper in a conveniently recoverable form and provides overall satisfactory results. As further example, hydrochloric acid would be preferred for titanium. For slow or mild etching, a weak acid such as acetic or phosphoric might be used. In addition, the acids may be used in various combinations with each other. For purposes herein, the preferred acid is sulfuric. The concentration of the acid may vary within broad limits provided it is present in an amount sufficient to reduce the pH of the etchant to below 7. In this respect, it has been found that for the etching of copper using sulfuric acid as the acid, etch rate is not appreciably increased as the acid concentration increases above 0.1N. Preferably, the acid content of the etchant varies between about 0.01N and 2.5N but more preferably varies between about 0.5 and 1.5N.

It is of interest to note that in an etchant stabilized with an arylsulfonic acid, as the concentration of molybdenum increases up to about 0.75 moles per liter, the normal peroxide consumption is reduced. This is suggestive that the molybdenum is the primary etchant and the peroxide consumption is not due to etching, but rather to oxidation of the reduced form of molybdenum.

In addition to exalting rate, molybdenum appears to inhibit attack on solder plate in contact with the metal etched. This is true only for those etchants utilyzing an acid that itself does not normally attack solder plate. For example, molybdenum will inhibit attack on solder plate in an etchant using sulfuric acid but will not inhibit attack on solder plate if nitric acid is substituted for the sulfuric acid.

In accordance with the most preferred embodiment of the invention, the etchant is stabilized to prevent catalytic decomposition of the peroxide caused by metal impurities. Though most stabilizers known to the art may be used, the preferred stabilizers are arylsulfonic acids or salts thereof as disclosed in the above-noted U.S. Pat. No. 3,801,512. A preferred stabilizer is phenol sulfonic acid. Other stabilizers that may be used include sulfosalicylic acid and toluene sulfonic acid. The concentration of the sulfonic acid may vary from as low as 1 gram per liter of solution to the solubility limit of the stabilizer but preferably varies between 3 and 30 grams per liter of solution.

Using the etchant of this invention to etch copper, at 120° F., the bath will dissolve about 70 to 80 grams of copper per liter. Maintaining the hydrogen peroxide concentration within 50–100% of its initial bath makeup and at all times in an amount sufficient to maintain a ratio of the peroxide to molybdenum of at least 1:1 permits continued operation until saturation with dissolved copper. Allowing the bath to cool to room temperature induces crystallization of copper compounds which may be recovered by filtration dependent upon the acid used. Readjustment in the concentration of the components of the etch solution makes the same suitable for reuse.

It is of interest to note that as etching proceeds, at the interface of the etchant and copper where etching is taking place, a deep blue layer forms which is the color of molybdenum in a lower valence form. This is suggestive that molybdenum has been reduced by oxidation of the copper layer and dissolution of the same. This deep blue color will persist at the interface unless the etchant is stirred. If stirred, the color is lost which is further suggestive that the reduced molybdenum has been reoxidized to hexavalent form by the peroxide. Moreover, if the peroxide is not present in solution, etching will proceed but only for a short period of time and thereafter, etching stops. While etching is taking place, the entire solution becomes deep blue establishing that molybdenum does etch copper but is not reoxidized in the absence of the peroxide.

The etchants of this invention are used for the same purposes as similar etchants of the prior art. They are particularly useful for the manufacture of printed circuit boards and for chemical milling. Procedures for the formation of printed circuit boards are described in numerous publications, for example, in Coombs PRINTED CIRCUITS HANDBOOK, McGraw-Hill Publishing Company, New York, 1967, Chapter 5, incorporated herein by reference.

In a typical process for the manufacture of printed circuit boards, a suitable base material is selected such as copper clad epoxy. Holes are drilled at appropriate locations on the board and the walls of the holes are metallized such as with copper to provide electrical contact between the two surfaces of the base material. Methods for metallization are known and include the steps of cleaning, catalyzing and electroless copper deposition.

Following metallization of the holes, utilizing a process known as pattern plating, a conductor pattern is formed on the copper by application of an organic resist material which may be either a photoresist or a screen resist dependent upon design and definition. The resist coats the copper that is not part of the conductor pattern and leaves the copper bare in a conductor pattern. The thickness of the conductor pattern is then increased using electroless and/or electrolytic copper plating procedures. Following the steps of copper plating, a dissimilar metal etch resist such as solder is applied over the copper in the conductor pattern to protect the same from subsequently applied etchants, the organic resist is removed exposing the unwanted copper (not part of the conductor pattern), and the unwanted copper is dissolved with a suitable etchant for the copper such as that disclosed herein while the conductor pattern is protected from the etchant by the dissimilar metal etch resist. Typically, the dissimilar metal etch resist is selected not only for its ability to withstand the etchant, but also for its solderability so the electrical connections can be soldered directly to the etch resist.

An alternative to pattern plating is a process known as panel plating. This procedure is similar to pattern plating except that the copper is built up to full thickness prior to application of the resist. The remaining steps are essentially the same. The process is less desirable as it involves deposition and removal of larger quantities of copper and hence, is less economical.

The invention will be better understood by reference to the following examples:

EXAMPLES 1-7

| Constituent | 1 | 2 | 3 | 4 | 5 | 6 | 7 |
|---|---|---|---|---|---|---|---|
| Sulfuric acid (50%)[1] ml | 200 | 200 | 200 | 200 | 200 | 200 | 200 |
| Hydrogen Peroxide (35%) ml | 100 | 100 | 100 | 100 | 100 | 100 | 100 |
| Sodium Molybdate (gm) | 0 | 1 | 5 | 10 | 20 | 50 | 100 |
| Phenolsulfonic acid gm | 16 | 16 | 16 | 16 | 16 | 16 | 16 |
| Water | | | | to 1 liter | | | |
| Time[2] to etch copper | | | | | | | |
| at 75° F (min) | 73 | 40 | 31 | 26 | 24 | 11 | 11 |
| at 120° F (min) | 13 | 6 | 4 | 3 | 3 | 5 | 8 |
| Hydrogen peroxide consumption during etching(percent) | 7.3 | 3.4 | 3.3 | 5.6 | 4.2 | 6.4 | 11 |

[1]Battery grade or better.
[2]By immersion of 1.4 mil copper clad epoxy substrate measuring 3" × 3" in etchant.

The above illustrates the effects of molybdenum concentration both on etch rate and peroxide consumption.

EXAMPLE 8

The etchant of Example 5 was used to continuously etch copper until the dissolved copper content exceeded 70 grams per liter. During this time, additions of peroxide and sulfuric acid were made as needed in order to achieve an acceptable etch rate at 120° F. Thereafter, the bath was cooled to about 70° F. and allowed to stand overnight, during which period of time, crystals formed in significant quantity which were believed to be copper sulfate pentahydrate.

EXAMPLES 9 & 10

Using Example 5 as a base formulation, other acids were substituted for sulfuric acid. The acids used, the amounts and the results obtained are as set forth in the following table:

| Acid | Amt (ml) | Time to etch 1 gm copper (min) at 75° F | Time to etch 1 gm copper (min) at 120° F |
|---|---|---|---|
| Hydrochloric (37%) | 166 | 18 | 6½ |
| Methane sulfonic (50%) | 188 | 9 | 2 |

From the above, it is apparent that other acids may be substituted for sulfuric for purposes of etching copper.

EXAMPLE 11

A printed circuit board is prepared from a copper clad epoxy G-10 substrate using the following sequence of steps:

(a) Clean the substrate and drill holes at appropriate locations.

(b) Metallize the walls of the holes by electroless plating including the steps of catalysis with a catalyst such as Catalyst 6F of Shipley Company Inc., accelerate with a mild acid solution and electrolessly plate copper such as with electroless copper CP-74 of Shipley Company Inc.

(c) Apply a positive working photoresist such as AZ-119, expose and develop.

(d) Electroplate copper to full desired thickness.

(e) Electroplate solder over the exposed copper.

(f) Remove the photoresist by dissolution in a suitable solvent therefor.

(g) Remove exposed copper by immersion of the board in the etchant of Example 5 until all unwanted copper is dissolved.

We claim:

1. An etchant comprising an acid solution of an oxidant combination of a peroxide and molybdenum, the peroxide being present in an amount sufficient to oxidize the molybdenum and provide sustained etching and the molybdenum being present in an amount sufficient to exalt the etch rate to a rate in excess of that achievable by the peroxide alone.

2. The etchant of claim 1 where the peroxide to molybdenum ratio is at least 1 to 1.

3. The etchant of claim 2 where the concentration of the peroxide varies between 0.1 and 10 moles per liter and the molybdenum concentration varies between 0.01 and 1.0 moles per liter.

4. The etchant of claim 2 where the concentration of the peroxide varies between 0.5 and 2.5 moles per liter and the concentration of the molybdenum varies between 0.02 and 0.5 moles per liter.

5. The etchant of claim 2 where the peroxide is hydrogen peroxide.

6. The etchant of claim 5 where the acid is sulfuric acid.

7. An etchant comprising an acid solution of an oxidizing combination of hydrogen peroxide and molybdenum, the peroxide being present in an amount of from about 0.1 to 10 moles per liter and the molybdenum being present in an amount of from about 0.01 to 1 moles per liter, the ratio of the peroxide to the molybdenum being at least 1 to 1.

8. The etchant of claim 7 where the acid is sulfuric acid.

9. The etchant of claim 8 where the concentration of the acid varies between 0.01 and 2.5 Normal, the concentration of the peroxide varies between 0.1 and 10 moles per liter and the concentration of the molybdenum varies between 0.01 and 1.0 moles per liter.

10. The etchant of claim 9 where the concentration of the acid varies between 0.5 and 1.5 Normal, the concentration of the peroxide varies between 0.5 and 2.5 moles per liter, the concentration of the molybdenum varies between 0.02 and 0.5 moles per liter and the ratio of the peroxide to the molybdenum is at least 1.2 to 1.

11. An etchant comprising an oxidant combination in a sulfuric acid solution, said oxidant combination comprising hydrogen peroxide and molybdenum, the sulfuric acid concentration varying between 0.01 and 2.5 moles per liter, the hydrogen peroxide concentration varying between about 0.1 and 10 moles per liter, the molybdenum concentration varying between about 0.02 and 0.5 moles per liter and the ratio of the peroxide to the molybdenum being at least 1 to 1.

12. The etchant of claim 11 where the concentration of the acid varies between 0.5 and 1.5 Normal, the concentration of the peroxide varies between 0.5 and 2.5 moles per liter, the concentration of the molybdenum varies between 0.02 and 0.5 moles per liter and the ratio of the peroxide to the molybdenum is at least 1.2 to 1.

13. A process for etching a metal comprising contact of the metal with the etchant of claim 1.

14. A process for etching a metal comprising contact of the metal with the etchant of claim 7.

15. A process for etching a metal comprising contact of the metal with the etchant of claim 11.

16. The process of claim 15 where the metal is copper.

17. In a process for the manufacture of a printed circuit board including the steps of applying a resist over a copper cladding and removing unwanted copper by etching, the improvement comprising etching said unwanted copper with the etchant of claim 11 to leave a pattern of copper behind.

18. The process of claim 17 including the steps of removing said resist and applying solder over the remaining patterned copper.

* * * * *